US010641221B2

(12) United States Patent
Filippi et al.

(10) Patent No.: US 10,641,221 B2
(45) Date of Patent: May 5, 2020

(54) ELECTROMAGNETIC INJECTION VALVE AND METHOD FOR ASSEMBLING AN ELECTROMAGNETIC INJECTION VALVE

(71) Applicant: Continental Automotive GmbH, Hannover (DE)

(72) Inventors: Stefano Carmela Filippi, Castel' Anselmo Collesalvetti (IT); Mauro Grandi, Leghorn (IT); Francesco Lenzi, Leghorn (IT); Valerio Polidori, Leghorn (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 57 days.

(21) Appl. No.: 15/767,431

(22) PCT Filed: Oct. 10, 2016

(86) PCT No.: PCT/EP2016/074135
§ 371 (c)(1),
(2) Date: Apr. 11, 2018

(87) PCT Pub. No.: WO2017/063972
PCT Pub. Date: Apr. 20, 2017

(65) Prior Publication Data

US 2018/0291849 A1 Oct. 11, 2018

(30) Foreign Application Priority Data

Oct. 12, 2015 (EP) ..... 15189302

(51) Int. Cl.
*F02M 51/06* (2006.01)
*F02M 61/16* (2006.01)
(Continued)

(52) U.S. Cl.
CPC .... *F02M 51/0614* (2013.01); *F02M 51/0653* (2013.01); *F02M 61/166* (2013.01);
(Continued)

(58) Field of Classification Search
CPC ..... F02M 51/0614; F02M 61/168; F02M 51/0653; F02M 63/0019; F02M 61/166;
(Continued)

(56) References Cited

U.S. PATENT DOCUMENTS 5,012,982 A * 5/1991 Souma ..... F02M 51/0682 239/585.4
8,729,995 B2 * 5/2014 Venkataraghavan ..... F02M 47/027 239/585.1
(Continued)

FOREIGN PATENT DOCUMENTS

CN 102506217 A 6/2012 ..... F02M 51/06
CN 202549532 U 11/2012 ..... F02M 51/06
(Continued)

OTHER PUBLICATIONS

Extended European Search Report, Application No. 15189302.1, 6 pages, dated May 3, 2016.
(Continued)

*Primary Examiner* — Joseph J Dallo
(74) *Attorney, Agent, or Firm* — Slayden Grubert Beard PLLC

(57) ABSTRACT

The present disclosure relates to internal combustion engines. Various embodiments may include an electromagnetic injection valve, particularly a solenoid type fluid injection valve for automotive applications. For example, an electromagnetic injection valve may include: an inlet tube; a valve body having a longitudinal axis and a cavity in which a valve needle moves; an upper magnetic ring press-fitted
(Continued)

with the inlet tube or the valve body; a lower magnetic ring press-fitted with the valve body; and a housing part surrounding an electromagnetic actuator unit for moving the valve needle. The lower magnetic ring is positioned on the valve body in such a way that an upper side of the lower magnetic ring is in close contact with an underside of the housing part. The electromagnetic actuator unit abuts the upper magnetic ring and the lower magnetic ring on opposite axial sides. The housing part and/or the lower magnetic ring comprises a cut extending along the axis.

13 Claims, 3 Drawing Sheets

(51) Int. Cl.
*F02M 63/00* (2006.01)
*H01F 7/16* (2006.01)

(52) U.S. Cl.
CPC ..... *F02M 61/168* (2013.01); *F02M 63/0019* (2013.01); *F02M 2200/08* (2013.01); *F02M 2200/8061* (2013.01); *F02M 2200/9061* (2013.01); *H01F 2007/1676* (2013.01)

(58) Field of Classification Search
CPC ..... F02M 2200/9061; F02M 2200/08; F02M 2200/8061; H01F 2007/1676
See application file for complete search history.

(56) References Cited

U.S. PATENT DOCUMENTS

| | | | | |
|---|---|---|---|---|
| 9,309,847 | B2 | 4/2016 | Schumacher et al. | |
| 9,541,046 | B2 * | 1/2017 | Yasukawa | F02M 51/061 |
| 2003/0178509 | A1 | 9/2003 | Porter | 239/585.1 |
| 2009/0139491 | A1 | 6/2009 | Joshi et al. | 123/476 |
| 2015/0136879 | A1 | 5/2015 | Rager et al. | 239/585.5 |
| 2018/0291849 | A1 * | 10/2018 | Filippi | F02M 51/0614 |

FOREIGN PATENT DOCUMENTS

| | | | | |
|---|---|---|---|---|
| CN | 103733279 | A | 4/2014 | F02M 51/06 |
| DE | 10312319 | A1 | 10/2003 | B05B 1/30 |
| DE | 10235240 | A1 | 2/2004 | F02M 47/02 |
| DE | 102012209229 | A1 | 12/2013 | F02M 47/02 |
| EP | 1078156 | B1 | 8/2002 | F02M 51/06 |
| EP | 2752858 | A2 | 7/2014 | F16K 31/06 |
| GB | 1078156 | A | 8/1967 | B01J 23/843 |
| WO | 2017/063972 | A1 | 4/2017 | F02M 51/06 |

OTHER PUBLICATIONS

International Search Report and Written Opinion, Application No. PCT/EP2016/074135, 12 pages, dated Jan. 17, 2017.
Chinese Office Action, Application No. 201680059814.X, 16 pages, dated Aug. 2, 2019.

* cited by examiner

ELECTROMAGNETIC INJECTION VALVE AND METHOD FOR ASSEMBLING AN ELECTROMAGNETIC INJECTION VALVE

CROSS-REFERENCE TO RELATED APPLICATIONS

This application is a U.S. National Stage Application of International Application No. PCT/EP2016/074135 filed Oct. 10, 2016, which designates the United States of America, and claims priority to EP Application No. 15189302.1 filed Oct. 12, 2015, the contents of which are hereby incorporated by reference in their entirety.

TECHNICAL FIELD

The present disclosure relates to internal combustion engines. Various embodiments may include an electromagnetic injection valve, particularly a solenoid type fluid injection valve for automotive applications.

BACKGROUND

A valve assembly for a fluid injection valve typically comprises a valve body comprising a cavity with a fluid inlet portion and a fluid outlet portion and a valve needle axially moveable in the cavity. The valve needle prevents a fluid flow through the fluid outlet portion in a closed position and releases the fluid flow through the fluid outlet portion in further positions. The valve needle may be actuated by an electromagnetic actuation unit.

DE 103 12 319 A1 discloses an injection valve with a lower magnetic ring to improve the performance of an electromagnetic valve. In this type of injection valve, the housing is often machined to create a pocket for the coil and to fit an inlet tube and a valve body. The material used for the housing has an impact on the magnetic performance of the injection valve, especially in conditions where it operates with a high fuel pressure. However, the choice of material used for the housing also has a severe influence on the costs of the injection valve. Furthermore, the existence of air gaps between parts which are penetrated by the magnetic flux also influences the magnetic performance.

SUMMARY

The teachings of the present disclosure may be embodied in an injection valve with a high magnetic performance, which may be manufactured at relatively low cost. For example, an electromagnetic injection valve (1) may comprise: an inlet tube (7), a valve body (3) having a longitudinal axis (5) and comprising a cavity, in which a valve needle is axially moveable; an upper magnetic ring (13) press-fitted with the inlet tube (7) or the valve body (3); a lower magnetic ring (15) press-fitted with the valve body (3); and a housing part (17) surrounding an electromagnetic actuator unit (9) of the injection valve (1) for moving the valve needle. The lower magnetic ring (15) is positioned on the valve body (3) in such a way that an upper side (31) of the lower magnetic ring (15) is in close contact with an underside (33) of the housing part (17). The electromagnetic actuator unit (9) abuts the upper magnetic ring (13) and the lower magnetic ring (15) on opposite axial sides. The housing part (17) and/or the lower magnetic ring (15) comprise at least one cut (23, 25) which extends in axial direction.

In some embodiments, the upper magnetic ring (13) is press-fitted with an external circumferential surface (70) of the inlet tube (7) or an external circumferential surface (30) of the valve body (3) and/or the lower magnetic ring (15) press-fitted with the external circumferential surface (30) of the valve body (3).

In some embodiments, the housing part (17) is positioned axially between the upper magnetic ring (13) and the lower magnetic ring (15).

In some embodiments, the housing part (17) is made of a magnetic material.

In some embodiments, the housing part (17) has the shape of a hollow cylinder and the lower magnetic ring (15) is separate from the housing part (17).

In some embodiments, the at least one cut (23, 25) in the housing part (17) and/or the lower magnetic ring (15) reaches entirely through the housing part (17) and/or the lower magnetic ring (15) in radial direction.

In some embodiments, the at least one cut (23, 25) in the housing part (17) and/or the lower magnetic ring (15) reaches only partially through the housing part (17) and/or the lower magnetic ring (15) in radial direction.

As another example, some embodiments may include a method for assembling an electromagnetic injection valve (1) comprising an inlet tube (7), a valve body (3) comprising a cavity, in which a valve needle is axially moveable and an electromagnetic actuator unit (9) for moving the valve needle. The method may include an upper magnetic ring (13) is press-fitted with the inlet tube (7) or the valve body (3); a housing part (17) is fitted surrounding the actuator unit (9) and overmolded, a lower magnetic ring (15) is press-fitted separately with the valve body (3) in such a way that an upper side (31) of the lower magnetic ring (15) is in close contact with an underside (33) of the housing part (17), and the upper magnetic ring (13) and the lower magnetic ring (15) are press-fitted onto the valve body (3) or onto the valve body (3) and the inlet tube (3) such that they abut opposite axial sides of the electromagnetic actuator unit (9) to fix an axial position of the electromagnetic actuator unit (9).

In some embodiments, the upper magnetic ring (13) is press-fitted with an external circumferential surface (70) of the inlet tube (7) or an external circumferential surface (30) of the valve body (3) and/or the lower magnetic ring (15) press-fitted with the external circumferential surface (30) of the valve body (3).

In some embodiments, the upper magnetic ring (13) is press-fitted with the valve body (3) or the inlet tube (7) in such a way that a lower side of the upper magnetic ring (13) is in close contact with an upper side of the housing part (17), the upper side facing away from the lower magnetic ring (15).

In some embodiments, the housing part (17) and/or the lower magnetic ring (15) comprise at least one cut (23, 25) which extends in axial direction.

BRIEF DESCRIPTION OF THE DRAWINGS

Further advantages, embodiments, and developments of the electromagnetic injection valve and the method for assembling the electromagnetic injection valve will become apparent from the exemplary embodiments which are described below in association with schematic figures.

Elements of the same design and function that appear in different illustrations are identified by the same reference character.

DETAILED DESCRIPTION

Figure 1:
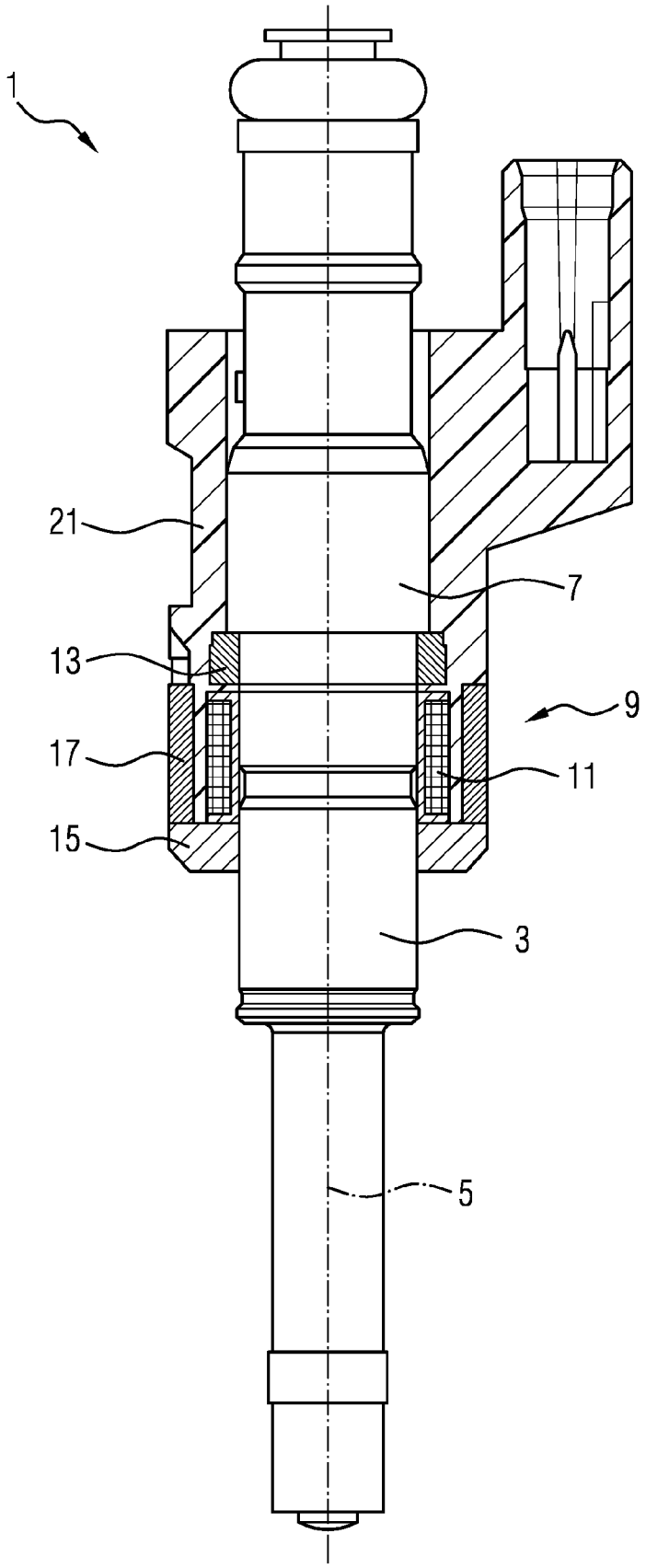
FIG. 1 shows an electromagnetic injection valve in a side view which is partially cut open in longitudinal direction, according to teachings of the present disclosure.

In some embodiments, an electromagnetic injection valve comprises an inlet tube and a valve body. The valve body has a longitudinal axis and comprises a cavity. A valve needle is arranged in the cavity in axially moveable fashion. The inlet tube and the valve body may hydraulically connect a fluid inlet end to a fluid outlet end of the injection valve. The fluid inlet end may be part of the inlet tube and the fluid outlet end may be part of the valve body.

In some embodiments, the injection valve further comprises a housing part which surrounds an electromagnetic actuator unit of the injection valve. The electromagnetic actuator unit is configured for moving the valve needle.

In some embodiments, an upper magnetic ring is press-fitted with the inlet tube or with the valve body. In some embodiments, a lower magnetic ring is press-fitted with the valve body. The housing part may be positioned axially between the upper magnetic ring and the lower magnetic ring.

In some embodiments, the upper magnetic ring is press-fitted with an external circumferential surface of the inlet tube or an external circumferential surface of the valve body and/or the lower magnetic ring press-fitted with the external circumferential surface of the valve body. In the present context, an "external circumferential surface" extends around the longitudinal axis and faces away from the longitudinal axis. In some embodiments, the external circumferential surfaces of fluid inlet tube and/or valve body are hydraulically separated from the cavity of the valve body. In some embodiments, the housing part and/or the lower magnetic ring comprise at least one cut which extends in axial direction. The cut may extend along the complete axial extension of the housing part or the lower magnetic ring, respectively.

By a cut extending in axial direction, it is understood that the cut extends essentially in axial direction, thereby preventing the build-up of eddy currents. A certain deviation from an axial direction does not make the cut ineffective and therefore is within the scope of the invention. For example, the cut extends parallel to the longitudinal axis or oblique to the longitudinal axis. In some embodiments, the inclination angle of the cut with respect to the longitudinal axis is less than 45°, and/or even less than 30°.

The prevention of eddy currents by means of the cut or the cuts has the advantage, that a high performance magnetic material can be used for the housing and/or the magnetic ring. Furthermore, the material for the housing could be chosen based on other properties, e.g., cost or workability.

The press-fit of the lower magnetic ring with the valve body ensures that there is no air gap between the lower magnetic ring and the valve body. Hence, magnetic performance is improved which makes it possible to operate the injection valve with fuel pressures of up to 250-500 bar.

In some embodiments, the housing part is made from a magnetic material, e.g. a magnetic metal or alloy such as magnetic steel. In this way, the electromagnetic field of the actuator may be efficiently guided by the upper magnetic ring, the housing part, and the lower magnetic ring.

In some embodiments, the housing part is manufactured of the magnetic material by a forming process. A forming process is understood to be a non-subtractive manufacturing process, for example rolling or deep-drawing, as opposed to machining processes, where a controlled material removal takes place. This has the advantage that suitable materials and/or processes are relatively cost-efficient and that the overall costs of the injection valve can be reduced.

In some embodiments, the at least one cut in the housing part and/or the lower magnetic ring reaches entirely through the housing part and/or the lower magnetic ring, in particular in radial direction. In other words, the lower magnetic ring or the housing part, respectively, is in the shape of a slotted ring or a slotted sleeve. This has the advantage that the part has a certain elasticity with regard to the press-fit.

In some embodiments, the at least one cut in the housing part and/or the lower magnetic ring reaches only partially through the housing part and/or the lower magnetic ring. In this case, the cut is made deep enough to substantially prevent the build-up of eddy currents. For example, the radial extension of the cut is 50% or more, in particular 70% or more, of the radial extension of the housing part or the lower magnetic ring, respectively. The radial extension of the housing part or the lower magnetic ring is in this context to be understood as the distance between the inner circumferential surface and the outer circumferential surface of the portion of the housing part or the lower magnetic ring, respectively, which is provided with the cut. In other words, it is the respective wall thickness.

In some embodiments, the housing part may be connected to the lower magnetic ring or made in one piece with the magnetic ring. In some embodiments, however, the housing part has the shape of a hollow cylinder and the lower magnetic ring is separate from the housing part. In this case, the magnetic ring is a separate component and is mounted independently from the housing part. The press-fit of the lower magnetic ring can be carried out independently from any other mounting process, thereby taking particular care to close an air gap between the lower magnetic ring and the valve body.

In some embodiments, the lower magnetic ring is positioned on the valve body in such fashion that an upper side of the lower magnetic ring is in close contact with an underside of the housing part. The upper side of lower magnetic ring and the underside of the housing part may be mutually facing surfaces of the lower magnetic ring and the housing part, respectively, which in particular face in opposite directions of the longitudinal axis.

In some embodiments, the housing part can be mounted before the lower magnetic ring and can be overmolded. Afterwards, the lower magnetic ring is mounted and press-fitted with the valve body, closing the air gap between the lower magnetic ring and the valve body and at the same time making close contact between the upper side of the lower magnetic ring and the underside housing part.

In some embodiments, the electromagnetic actuator unit abuts the upper magnetic ring and the lower magnetic ring on opposite axial sides. In other words, the upper magnetic ring abuts a first axial side of the actuator unit and the lower magnetic ring abuts a second axial side of the actuator unit, remote from the first axial side. For example, the upper and lower magnetic rings abut a bobbin of the coil of the electromagnetic actuator unit on opposite axial sides of the bobbin. With advantage, an axial position of the electromagnetic actuator unit may be fixed by the upper and lower magnetic rings in this way.

In some embodiments, a method for assembling the electromagnetic injection valve corresponds to at least one of the previously described embodiments. For example, an upper magnetic ring may be press-fitted with the inlet tube or the valve body, in particular with an external circumferential surface of the inlet tube or the valve body. A housing part is fitted surrounding the actuator unit and overmolded. A lower magnetic ring is press-fitted separately with the valve body, in particular with the external circumferential surface of the valve body. The housing part and/or the lower magnetic ring may include at least one cut which extends in an axial direction.

Some methods may be cost-efficient and yields a high performance injection valve, which is suitable for high-pressure applications as well as for low pressure port fuel applications and/or direct or indirect gas applications. In some embodiments, the lower magnetic ring is press-fitted with the valve body in such a way that an upper side of the lower magnetic ring is in close contact with an underside of the housing part. With advantage, air gaps may be reduced or avoided in this way and the magnetic performance of the injection valve may be particularly good.

In some embodiments, the upper magnetic ring is press-fitted with the valve body or the inlet tube in such a way that a lower side of the upper magnetic ring is in close contact with an upper side of the housing part the upper side facing away from the lower magnetic ring. With advantage, air gaps may be reduced or avoided in this way and the magnetic performance of the injection valve may be particularly good. In this context, "close contact" refers to direct mechanical contact, in particular full-area mechanical contact, of the respective parts.

In some embodiments, the upper magnetic ring and the lower magnetic ring are press-fitted onto the valve body—or onto the valve body and onto the inlet tube as the case may be—such that they abut opposite axial sides of the electromagnetic actuator unit—and in particular of the bobbin of the coil—to fix an axial position of the electromagnetic actuator unit.

Figure 2:
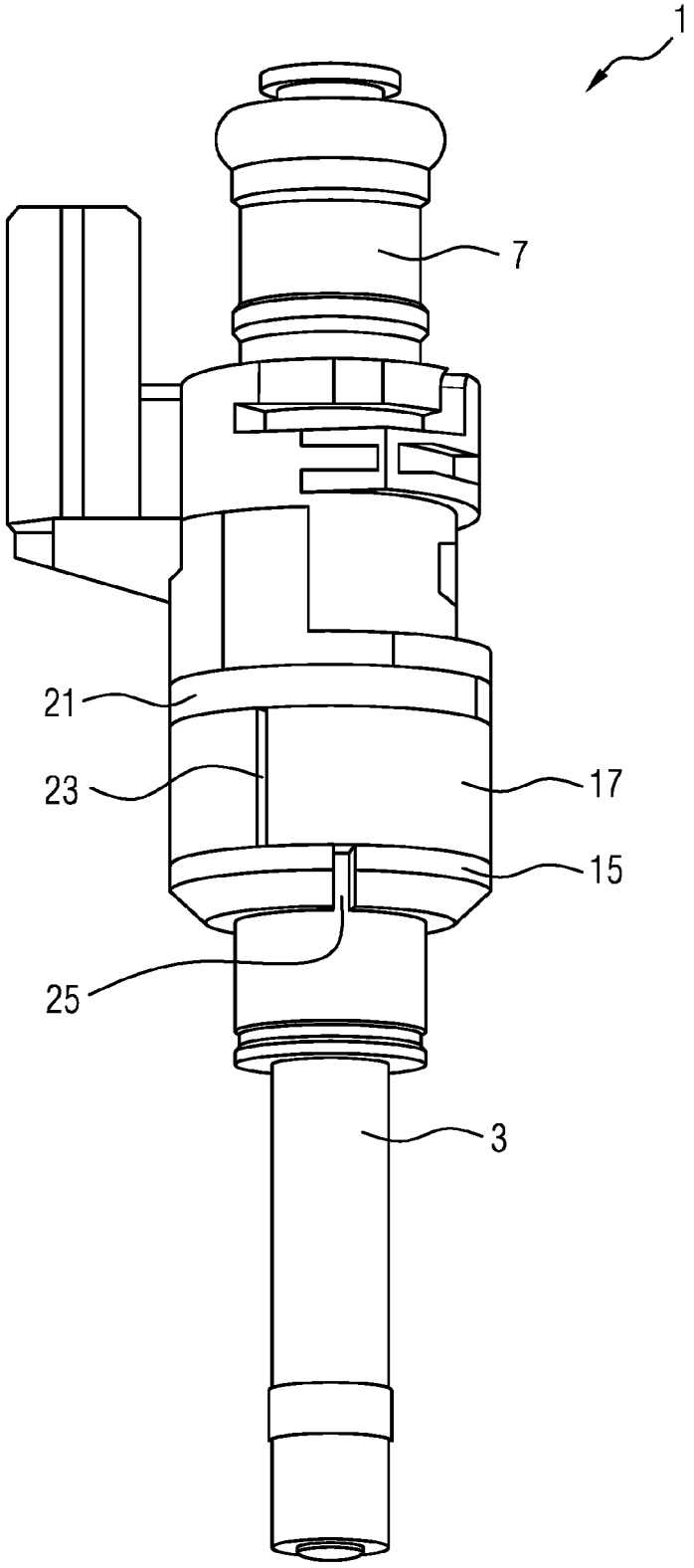
FIG. 2 shows a perspective view of the electromagnetic injection valve according to FIG. 1.
Figure 3:
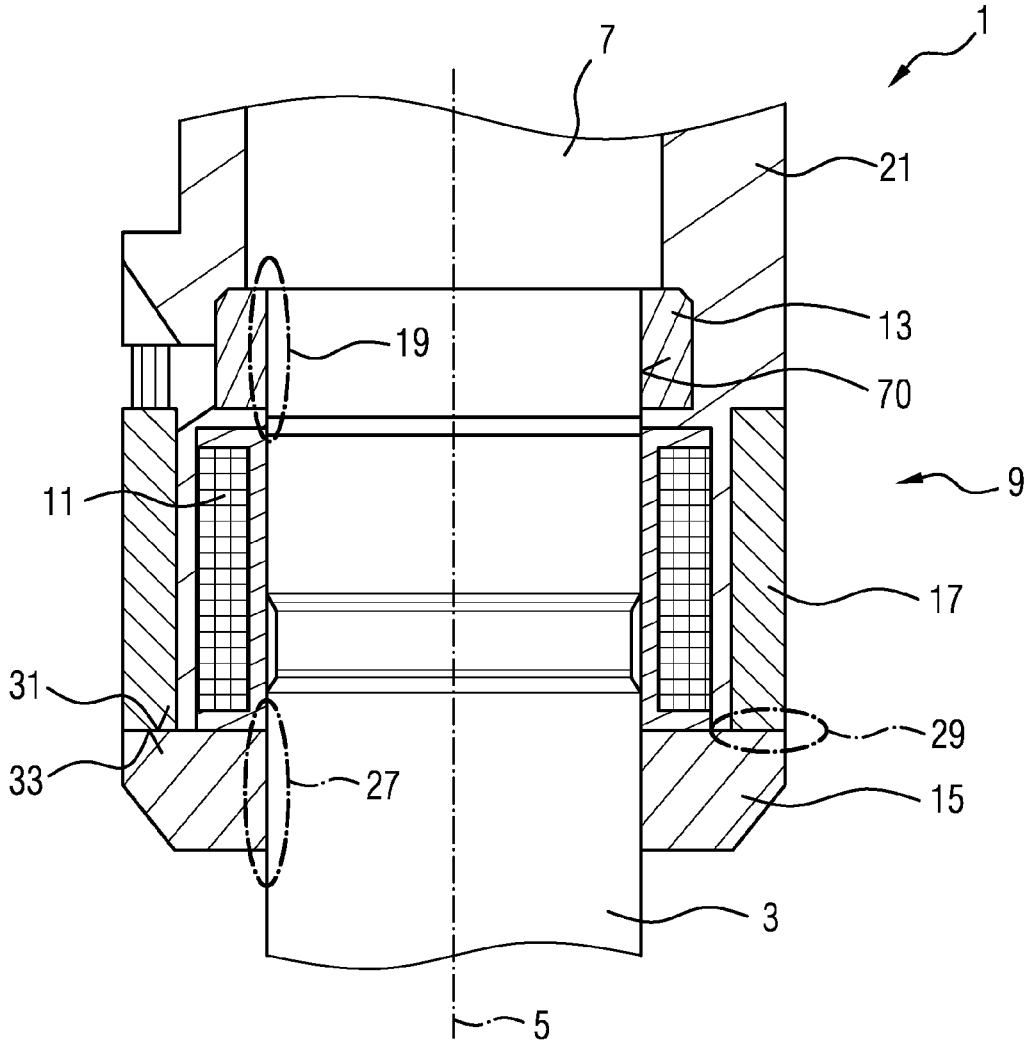
FIG. 3 shows a detail of the electromagnetic injection valve according to FIG. 1.

The electromagnetic injection valve 1 shown in FIGS. 1 to 3 is suitable for dosing fuel to an internal combustion engine. However, it could be used in other types of electromagnetic injection valves, too. The injection valve 1 comprises a valve body 3 having a central longitudinal axis 5 and an inlet tube 7. The valve body 5 and the inlet tube 7 comprise a cavity.

The cavity is not visible in FIG. 1 which shows the valve body 3 and the inlet tube 7 only in a side view, not cut open. The cavity has a fluid outlet portion that communicates with a fluid inlet portion. The fluid inlet portion and the fluid outlet portion are positioned at opposite axial ends of the injection valve 1, the fluid inlet portion being part of the inlet tube 7 and the fluid outlet portion being part of the valve body 3. In the cavity, a valve needle is axially moveable to seal and unseal the fluid outlet portion for controlling fluid flow out of the injection valve 1.

The injection valve 1 furthermore comprises an electromagnetic actuator unit 9, which includes a coil 11, an upper magnetic ring 13, and a lower magnetic ring 15. The upper magnetic ring 13 and the lower magnetic ring may represent magnetic yokes of the actuator unit 9. Another part of the magnetic circuit is the housing part 17, which is penetrated by the magnetic flux.

The magnetic rings 13, 15 and the housing part 17 are made of a magnetic material. The valve body 3 and, in some embodiments, the inlet tube 7 may also be made of a magnetic material, at least in places. The magnetic material may comprise a ferromagnetic material. In some embodiments, the magnetic circuit through the upper magnetic ring 13, the housing part 17, the lower magnetic ring 15, the valve body 3, and the inlet tube 7 may not contain air gaps.

The upper magnetic ring 13 is press-fitted with an external peripheral surface 70 of the inlet tube 7 in a first region 19 indicated in FIG. 3. The upper magnetic ring 13 and the coil 11 are overmolded with a plastic overmolding 21 and the housing part 17 is embedded in the plastic overmolding 21, too.

The lower magnetic ring 15 is press-fitted with an external peripheral surface 30 of the valve body 3 in a second region 27 indicated in FIG. 3. In a third region 29, the upper side 31 of the lower magnetic ring 15 makes close contact with the underside 33 of the housing part 17. There is no radial air gap between the lower magnetic ring 15 and the valve body 3 due to the press-fit in the second region 27.

As shown in FIG. 2, the housing part 17 has a cut 23 extending in axial direction. The lower magnetic ring 15 also has a cut 25 extending in axial direction. The cuts 23 and 25 reach entirely through the housing part 17 and the lower magnetic ring 15, respectively, in radial and axial direction to prevent the build-up of eddy currents.

What is claimed is:

1. An electromagnetic injection valve comprising:

an inlet tube;

a valve body having a longitudinal axis and a cavity in which a valve needle is axially moveable;

an upper magnetic ring press-fitted with the inlet tube or the valve body;

a lower magnetic ring press-fitted with the valve body; and a housing part surrounding an electromagnetic actuator unit for moving the valve needle;

wherein the lower magnetic ring is positioned on the valve body in such a way that an upper side of the lower magnetic ring is in close contact with an underside of the housing part;

the electromagnetic actuator unit abuts the upper magnetic ring and the lower magnetic ring on opposite axial sides; and at least one of the housing part and the lower magnetic ring comprises a cut extending along the axis.

2. An electromagnetic injection valve according to claim 1, wherein the upper magnetic ring is press-fit onto an external circumferential surface of the inlet tube or an external circumferential surface of the valve body.

3. An electromagnetic injection valve according to claim 1, wherein the housing part is positioned axially between the upper magnetic ring and the lower magnetic ring.

4. An electromagnetic injection valve according to claim 1, wherein the housing part comprises a magnetic material.

5. An electromagnetic injection valve according to claim 1, wherein the housing part comprises a hollow cylinder and the lower magnetic ring is separate from the housing part.

6. An electromagnetic injection valve according to claim 1, wherein the cut extends entirely through the housing part or the lower magnetic ring in a radial direction.

7. An electromagnetic injection valve according to claim 1, wherein the cut extends only partially through the housing part and/or the lower magnetic ring in a radial direction.

8. A method for assembling an electromagnetic injection valve comprising an inlet tube, a valve body comprising a cavity in which a valve needle is axially moveable, and an electromagnetic actuator unit for moving the valve needle, the method comprising:

press-fitting an upper magnetic ring onto the inlet tube or the valve body;

fitting a housing part surrounding the actuator unit;

overmolding the housing part; and press-fitting a lower magnetic ring separately with the valve body in such a way that an upper side of the lower magnetic ring is in close contact with an underside of the housing part;

wherein the upper magnetic ring and the lower magnetic ring are disposed such that they abut opposite axial sides of the electromagnetic actuator unit to fix an axial position of the electromagnetic actuator unit.

9. A method according to claim 8, wherein the upper magnetic ring is press-fit onto an external circumferential surface of the inlet tube or an external circumferential surface of the valve body.

10. A method according to claim 8, wherein the upper magnetic ring is press-fit onto the valve body or the inlet tube in such a way that a lower side of the upper magnetic ring is in close contact with an upper side of the housing part, the upper side facing away from the lower magnetic ring.

11. A method according to claim 8, wherein at least one of the housing part and the lower magnetic ring comprises a cut extending in an axial direction.

12. An electromagnetic injection valve according to claim 1, wherein the lower magnetic ring is press-fit onto an external circumferential surface of the valve body.

13. A method according to claim 8, wherein the lower magnetic ring is press-fit onto an external circumferential surface of the valve body.

* * * * *